United States Patent [19]

Epper et al.

[11] 4,298,159

[45] Nov. 3, 1981

[54] SOLID SLEEVE WORM CENTRIFUGE

[75] Inventors: Wolfgang Epper, Bergheim-Zievenich; Wolfgang Heckman, Bergisch-Gladbach, both of Fed. Rep. of Germany

[73] Assignee: Klöckner-Humboldt-Deutz AG, Fed. Rep. of Germany

[21] Appl. No.: 21,693

[22] Filed: Mar. 19, 1979

[30] Foreign Application Priority Data

Mar. 25, 1978 [DE] Fed. Rep. of Germany ..... 2813140

[51] Int. Cl.[3] ..... B04B 1/20

[52] U.S. Cl. ..... 233/7; 233/46

[58] Field of Search ..... 233/3, 6, 7, 8, 9, 10, 233/12, 14 R, 14 A, 1 D, 1 R, 46, 47 R; 366/175, 174, 170, 169

[56] References Cited

U.S. PATENT DOCUMENTS 2,308,559 1/1943 Winkler ..... 233/7

2,766,930 10/1956 Schmiedel ..... 233/7

3,782,623 1/1974 Larsen ..... 233/7

3,955,756 5/1976 Hiller ..... 233/7

*Primary Examiner*—Robert W. Jenkins

*Attorney, Agent, or Firm*—Hill, Van Santen, Steadman, Chiara & Simpson

[57] ABSTRACT

A solid sleeve worm centrifuge having a cylindrical separating portion and a conical discharge portion is provided with a static plate attached to the rotating worm in the area of transition from the cylindrical portion to the conical portion. The static plate prevents the backflow of solids already precipitated from the conical portion to the cylindrical portion of the centrifuge. Intensive dehydration of the separated solids is thus achieved, so that the solids may be stored directly or processed further without additional liquid removal treatment. A liquid withdrawal conduit is provided in the cylindrical portion of the centrifuge to continuously remove liquid separated from a solid-liquid mixture.

11 Claims, 3 Drawing Figures

SOLID SLEEVE WORM CENTRIFUGE

BACKGROUND OF THE INVENTION

The dehydration of waste water slurry separated from a solid-liquid mixture by a solid sleeve centrifuge presents the problem of preventing the separated solid and liquid from remixing together in the discharge area of the centrifuge. It is desirable that such re-mixing be held to an absolute minimum so that additional treatment of the discharged solids is not necessary, and the solids may be stored or reprocessed in the state from which they are discharged from the centrifuge.

An attempted solution, as shown in the German Laid Open Specification No. 1,532,678 was to position a static plate or disc on the rotating worm in the area of transition from the cylindrical portion to the conical portion. The centrifuge was then operated in such a manner so as to maintain a relatively high liquid level in the cylindrical sleeve portion which, in combination with the static plate, prevented backflow of the precipitated solids to some degree. This solution has the disadvantage of also preventing backflow of liquid which is still mixed with the solids in the conical discharge portion of the centrifuge. Further demoisturizing of the solids in the discharge portion of the centrifuge is therefore not possible, because the liquid mixed with the solids in the discharge portion is discharged along with the solid.

In accordance with the present invention, a method and apparatus for post-dehydration of solids separated from the liquid in the cylindrical separating portion of the centrifuge consists in providing a static plate attached to the rotating worm in the transition area between the cylindrical and conical portions, and also providing liquid conducting members carried on the cylindrical portion of the worm which communicate beyond the static plate to allow additional demoisturizing of solids in the conical portion of the centrifuge.

It is thus an object of the present invention through these measures to attain a higher degree of post-dehydration of the solids in the conical sleeve portion of the centrifuge to such an extent that the discharged solids may be stored directly therefrom or may be burnt with only slight expenditure of fuel.

A further object of the invention is to minimize disturbances in the cylindrical sleeve portion of the centrifuge which may result from uncontrolled backflow of liquid from the conical to the cylindrical portion of the centrifuge.

Another object of the present invention is to improve separation of solids and liquids in a solid-liquid mixture by preventing re-mixing of liquids removed from the solid in the discharged portion of the centrifuge with liquids and solids in the separating portion of the centrifuge. Liquid flowing back from the conical portion to the cylindrical portion may vary in solid content depending upon the nature of the mixture being separated. Preventing this backflowing liquid from remixing with materials in the cylindrical separating portion of the centrifuge results in solids having a lower liquid content reaching the discharge portion of the centrifuge.

Further details, features and advantages of the invention will be apparent from the following explanation of the embodiments shown in the drawings.

IN THE DRAWINGS

DESCRIPTION OF THE PREFERRED EMBODIMENTS

Figure 1:
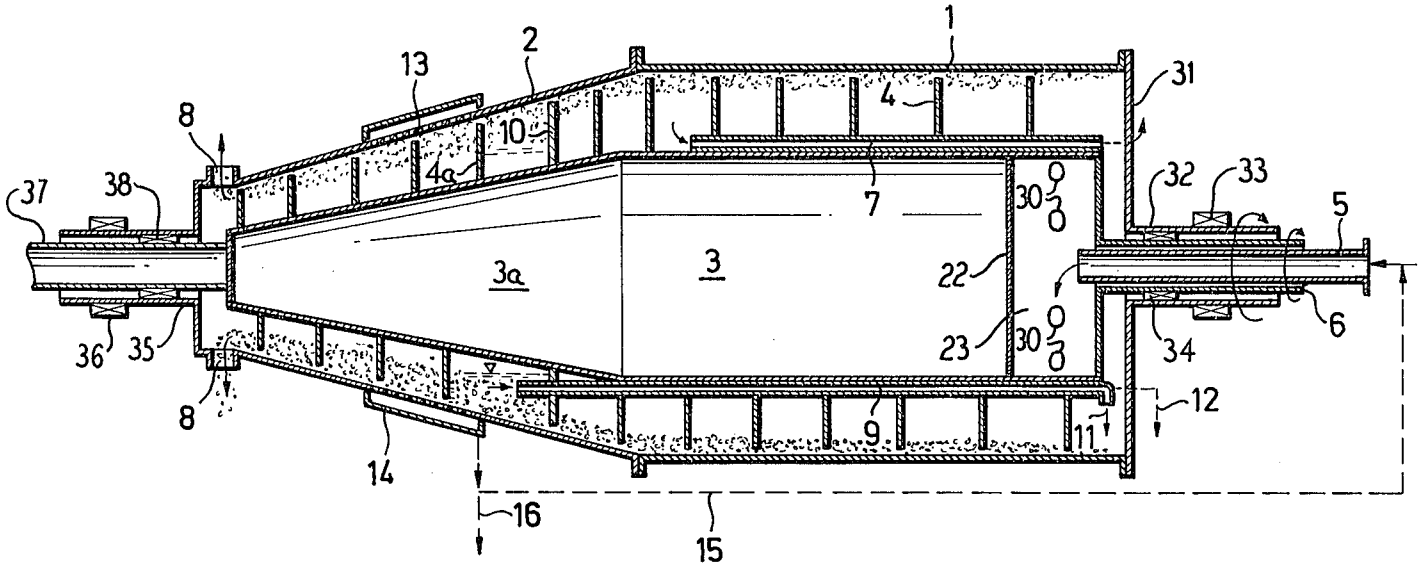
FIG. 1 shows a longitudinal cross section of a solid sleeve worm centrifuge having liquid conducting members extending axially outwardly on the worm body.

As shown in FIG. 1 a solid sleeve worm centrifuge has a cylindrical sleeve portion 1 and a conical sleeve portion 2 joined thereto. A correspondingly constructed worm conveyor rotates inside of the sleeve portions 1 and 2 and has a cylindrical worm body 3 on which a cylindrical helical worm 4 is carried. The worm conveyor also has a conical worm body 3*a* on which a conical worm 4*a* is carried.

The centrifuge has a back plate 31 attached to the cylindrical sleeve 1 which has a tubular extension 32 integrally formed thereon. At an opposite end of the centrifuge, the concical sleeve portion 2 terminates in a similar tubular extension 35. The tubular extensions 32 and 35 are respectively journaled on bearings 33 and 36 so that the entire centrifuge sleeve consisting of the cylindrical portion 1 and the conical portion 2 can be rotated by any suitable means (not shown).

The cylindrical worm body 3 also has a tubular extension 6 which extends coaxially through the extension 32 and is supported therein by a bearing 34. Similarly, at the opposite end of the centrifuge, a supporting tube 37 extends from the conical worm body 3*a* coaxially through the tubular extension 35 and is supported therein by a bearing 38. The worm conveyor consisting of the cylindrical worm body 3 and the conical worm body 3*a* can thus be independently rotated inside the sleeve by any suitable means (not shown).

An input pipe 5 extends into the interior of the cylindrical worm body 3 through the extension 6. A liquid-solid mixture to be separated is introduced into the centrifuge through the input pipe 5 to a chamber 23 formed by the cylindrical worm body 3 and an interior vertical wall 22. The mixture is expelled by the forces generated by rotation of the worm body 3 through a plurality of apertures 30.

A liquid withdrawal member 7 is carried on the worm body 3 to provide for the discharge of separated liquid in the cylindrical portion 1 of the centrifuge.

In the general area of transition between the cylindrical worm body 3 and the conical worm body 3*a*, a static plate or disc 10 is attached to the conical worm body 3*a* to prevent the back-flow of solids from the conical portion 2 to the cylindrical portion 1 of the centrifuge. A second withdrawal conduit 9 is provided which extends through the plate 10 into the conical portion of the centrifuge. Additional liquid may thus be removed from any solids in the discharge portion of the centrifuge through the conduit 9. This liquid may either be reintroduced at 11 into the cylindrical portion of the centrifuge for additional separation, or externally discharged at 12 and disposed of.

Additionally, a plurality of apertures 13 in the conical sleeve portion 2 provide another means for removal of liquid from solids in the discharge area of the centrifuge. Liquid passing through the apertures 13 is collected in a trough 14 and may either be directly disposed of at 16 or reintroduced by the input pipe 5 by means of a feedback conduit represented by the arrow 15. The dehydrated solid is ultimately discharged at the end of the conical portion 2 of the centrifuge at 8.

Figure 2:
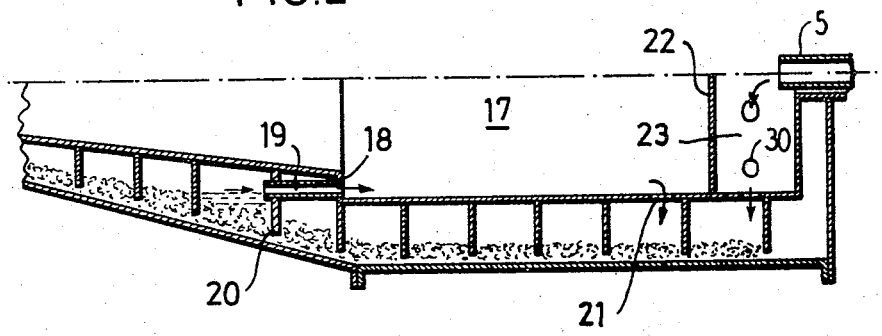
FIG. 2 is a partial section view of a solid sleeve worm centrifuge having a liquid conducting member communicating with the interior of the worm body.

A second embodiment of the invention is shown in FIG. 2 in which an interior 17 of a cylindrical portion of the centrifuge communicates directly with the discharge area of the centrifuge by means of a conduit 19 connected to a passage 18 communicating with the interior 17. The conduit 19 extends through a static plate 20 indentical to that described in FIG. 1. Additionally, the input pipe 5, vertical wall 22, chamber 23 and the apertures 30 are as described in FIG. 1. The liquid returning from the discharge portion through the conduit 19 is reintroduced for additional separation in the cylindrical portion of the centrifuge by means of a plurality of apertures 21 communicating with the interior of the cylindrical worm body.

Figure 3:
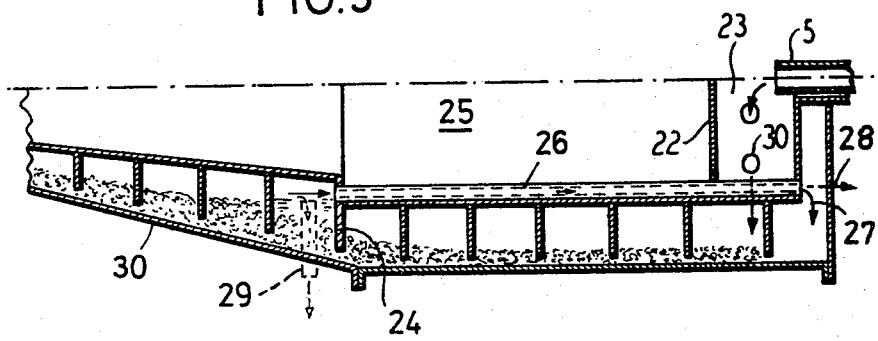
FIG. 3 is a partial section view of a solid sleeve worm centrifuge having a liquid discharge tap in the conical portion thereof.

A further embodiment of the invention is shown in FIG. 3 in which a static plate 24 is mounted exactly at the point on the worm conveyor at which the worm body changes from a cylinder to a cone. In this embodiment liquid from the discharge portion of the centrifuge may be reintroduced to the cylindrical portion by means of a conduit 26 extending through and an interior 25 of the cylindrical worm body. The liquid in the conduit 26 may thus be reintroduced into the cylindrical portion at 27, or discharged and disposed of at 28. Additionally, liquid from the solids in the discharge portion of the centrifuge may be directly removed by a tap radially disposed in the conical sleeve as shown at 29. The input pipe 5, the vertical wall 22, the chamber 23 and the apertures 30 are as described in FIG. 1.

The inventive concept herein may also be effectively embodied in centrifuges other than those of the solid-sleeve type, such as centrifuges having a one-step hydraulic drive interconnected between the conical and cylindrical worm bodies, allowing the portions of the worm to rotate at different speeds.

Although various modifications and changes may be apparent to those skilled in the art, it is the intention of the inventors to embody within the patent warranted hereon all such changes and modifications as reasonably and properly come within the scope of the inventors contribution to the art.

We claim as our invention:

1. A solid sleeve worm centrifuge for the separation of solids and liquid in a solid-liquid mixture comprising:

a cylindrical portion for the separation of said mixture;

a conical portion for the discharge of separated solids, said conical portion attached in coaxially alignment with said cylindrical portion;

a conveyor worm having a cylindrical worm body portion which begins to taper in a transition region to form a conical worm body portion at one end thereof, and which is rotatable inside said centrifuge for moving solids to be discharged through said centrifuge;

a static plate mounted on said worm conveyor in said transition region; and a liquid withdrawal means which communicates with an interior of said conical portion of said centrifuge at a location behind said static plate in the direction of flow through said centrifuge for removing liquid from solids in said conical portion.

2. The solid sleeve worm conveyor of claim 1 wherein said liquid withdrawal means is a plurality of radially outwardly extending taps mounted in said conical portion of said centrifuge downstream of said static plate.

3. The solid sleeve worm centrifuge of claim 1 wherein said liquid withdrawal means communicates with said cylindrical portion of said centrifuge so that liquid removed from said conical portion of said centrifuge can be reintroduced to said cylindrical portion for further separation thereof.

4. The solid sleeve worm centrifuge of claim 1 wherein said liquid withdrawal means is an axially mounted conduit on said worm conveyor, one end of which extends into said conical portion of said centrifuge and through said static plate in sealed relation therewith.

5. The solid sleeve worm centrifuge of claim 1 wherein said liquid withdrawal means is an axially extending conduit through said static plate in sealed relation therewith and connecting an interior of said conical portion of said centrifuge with an interior of said cylindrical worm body portion, and wherein said liquid withdrawal means further comprises a plurality of apertures in said cylindrical worm body portion to return liquid entering the interior of said cylindrical worm body portion to the cylindrical portion of the centrifuge.

6. The solid sleeve worm centrifuge of claim 1 wherein said liquid withdrawal means is a plurality of apertures in said conical portion of said centrifuge which allow liquid in said conical portion of said centrifuge to drain into a trough surrounding said apertures.

7. The solid sleeve worm centrifuge of claim 1 wherein said second end of said liquid withdrawal conduit empties into said cylindrical portion of said centrifuge to return liquid removed from said conical portion to said cylindrical portion for additional separation.

8. A solid sleeve worm centrifuge for the separation of solids and liquid in a solid-liquid mixture comprising:

a cylindrical portion for the separation of said mixture having a cylindrical worm conveyor surrounded by a cylindrical sleeve;

a conical portion for the discharge of separated solids having a conical worm conveyor coaxially attached to said cylindrical worm conveyor and a conical sleeve coaxially attached to said cylindrical sleeve;

a static plate mounted on said conical worm conveyor in a region at the base of said cone;

a liquid withdrawal conduit axially mounted on said cylindrical worm conveyor and having a first end which extends through said static plate in sealed relation therwith into said conical portion of said centrifuge and having a second end for the discharge of liquid removed from said conical portion of said centrifuge;

a drainage means comprised of a plurality of apertures in said conical sleeve which allow liquid from said conical portion of said centrifuge to drain into a trough surrounding said apertures; and a discharge means for removing separated solids from said conical portion of said centrifuge located at an apex of said conical portion.

9. The solid sleeve worm centrifuge of claim 7 wherein said trough is connected to said cylindrical portion of said centrifuge to empty liquid drained from said conical portion into said cylindrical portion for additional separation.

10. A method for the separation of solids and liquid in a solid liquid mixture comprising the steps of:

separating said solids and liquid in a cylindrical portion of a centrifuge;

discharging separated solids through a conical portion of a centrifuge attached to said cylindrical portion of said centrifuge;

preventing backflow of solids in said conical portion of said centrifuge by means of a static plate mounted in said conical portion;

further removing liquid contained in said separated solids while said solids are in said conical portion on said centrifuge behind said static plate.

11. The method of claim 10 including the additional step of returning removed liquid to said cylindrical portion of said centrifuge for additional separation.

* * * * *